United States Patent [19]

Mizuma

[11] 4,379,549

[45] Apr. 12, 1983

[54] SHEET PAPER STACKING APPARATUS

[75] Inventor: Kenichi Mizuma, Kawasaki, Japan

[73] Assignee: Ricoh Company, Ltd., Japan

[21] Appl. No.: 233,623

[22] Filed: Feb. 12, 1981

[30] Foreign Application Priority Data

Feb. 29, 1980 [JP] Japan ..... 55-24712

[51] Int. Cl.[3] ..... B65H 5/22

[52] U.S. Cl. ..... 271/3.1; 271/163; 271/186; 271/236; 271/241; 271/251

[58] Field of Search ..... 271/236, 237, 238, 241, 271/251, 3.1, 207, 163, 186

[56] References Cited

U.S. PATENT DOCUMENTS 3,900,192 8/1975 Gibson ..... 271/3.1
3,907,276 9/1975 Gerbasi ..... 271/251 X
3,989,236 11/1976 Komori ..... 271/3.1 X
4,017,066 4/1977 Lasher ..... 271/251 X
4,257,587 3/1981 Smith ..... 271/236

*Primary Examiner*—Richard A. Schacher
*Attorney, Agent, or Firm*—Guy W. Shoup; Gerard F. Dunne

[57] ABSTRACT

An apparatus for receiving sheets of paper from a copying machine or the like includes a tray receiving a stack of sheets on a bottom plate. A side reference plate and a front reference plate are provided on portions of the plate to align the sheets of paper properly within the tray. A roller inclined relative to the side and front reference plates is rotated in contact with the sheets entering the tray to assure they are properly positioned, and means are provided for selectively discharging sheets from the tray.

13 Claims, 4 Drawing Figures

SHEET PAPER STACKING APPARATUS

BACKGROUND OF THE INVENTION

1. Field of the Invention

This invention relates to a stacking apparatus for arranging sheet of paper in the form of a stack, and more particularly, to a sheet paper stacking apparatus which receives sheet of paper one by one and arranges them in a stack with the front edge and one side edge of each sheet aligned with a front reference line and a side reference line, respectively. The present invention is particularly advantageous to be employed in duplex copying or printing machines which make reproductions or prints on both sides of the paper.

2. Description of the Prior Art

When making reproductions or prints on both sides of a sheet of paper by a duplex copying or printing machine, a common practice is that a reproduction or print is first formed on one side of the sheet of paper, and then the sheet of paper is turned upside down for processing the remaining side thereof. An electrophotographic copying machine usually comprises a photosensitive drum which is journaled in a frame to rotate in a predetermined direction at a constant speed; on the other hand, a printing machine has a printing roller which is rotatably supported in a frame. A sheet of paper is brought into contact with the rotating photosensitive drum or the printing roller for transferring the developed image on the drum or the ink image on the roller onto the surface of the sheet of paper. It is therefore required that the sheet of paper be transported in synchronism with the rotation of the drum or roller and with a particular spatial relationship with respect to the drum or roller in order that the image can be properly transferred onto the sheet of paper.

In duplex reproducing and printing operations, the above-noted problem of timing and alignment is more severe as compared with the ordinary single side reproducing and printing operations. Because the sheet of paper, upon completing reproduction or printing on one side, must be turned upside down, and again it must be brought into contact with the photosensitive drum or the printing roller for the second reproducing or printing operation. Thus, a tray is usually provided to receive sheets of paper after completing reproduction or printing on one side so as to facilitate the required timing and alignment procedure. The use of such a tray is advantageous in a duplex processing, but there are several requirements to be met. For example, when sheets of papers are introduced into such a tray one by one after processing of the front side, they must be stacked one upon another with their front edge and one side edge properly aligned with front and side reference lines, respectively, ready for the reverse side processing.

Conventionally, use has been made of an end block and side blocks, respectively provided at the front end and on both sides of the tray. With such a conventional structure, sheets of papers are introduced into the tray by a transporting mechanism and they are left there to themselves to take the proper position in abutment against the blocks. This structure is disadvantageous because the side blocks, and possibly the end block too, must be made adjustable and their locations must be individually determined in accordance with the size of the sheets of papers used. Moreover, if a sheet of paper is somewhat disoriented, i.e., oriented aslant with respect to the centerline of the normal sheet paper travelling path, or shifted sideways when introduced into the tray, the front edge of the sheet paper could bump into the end of one side block, resulting in the occurrence of jamming.

It has also been proposed to use a pressing plate for the purpose of attaining a perfect alignment of the sheets of paper when stacked in the tray. However, such a pressing plate must be operated in association with the transport of the sheets of paper to bring them to properly abut against the reference walls. In addition, the stroke of the pressing plate must be adjusted in accordance with the size of sheets of paper used. Therefore, use of such a pressing plate necessarily complicates the structure of a sheet paper stacking apparatus and, therefore, it is rather disadvantageous in a practical sense, though sheet papers can be properly aligned with reference lines.

SUMMARY OF THE INVENTION

As will be explained later in detail, the present apparatus comprises a front reference plate and a side reference plate disposed perpendicularly to the front reference plate, whereby the surface of each of the reference plates respectively defines a front reference line and a side reference line. The apparatus further comprises a bottom plate on which a stack of sheets of paper is formed and forcing means for forcibly bringing the sheets of paper one by one into contact with the front and side reference plates. The forcing means preferably comprises a roller which is driven to rotate and contactable with the sheet of paper to exert a predetermined force thereon in a desired direction, and, preferably, it is movable between two positions, i.e., one in contact with the topmost sheet of the stack and the other separated away from the topmost sheet.

Preferably, the bottom plate, together with the side reference plate, if desired, is so structured that it may change its relative positional relationship with respect to the front reference plate. It is, however, intended that the bottom plate virtually maintaines its perpendicular relationship against the front reference plate, through the relative positional relationship between them changes. With such a structure, the topmost sheet of the stack on the bottom plate may be brought into contact with a delivery roller to discharge sheet papers one by one under control. During this discharging operation, the forcing means takes the position away from the topmost sheet, thereby insuring a proper discharging operation.

Preferably, a predetermined gap is provided between the front reference plate and the side reference plate. There are several ways to provide such a gap, but it is most preferable to provide the gap in such a manner as providing the front reference plate which fully extends across the sheet paper travelling path and terminating the downstream end of the side reference plate at a predetermined distance upstream of the front reference plate. Provision of such a gap insures proper positioning of sheets of paper even if they are somewhat disoriented when they first make the first contact with either of the reference plates.

At the entrance of the present apparatus, it is preferable that a sheet of paper which is about to be entered has that side edge which is closer to the side reference plate located at a distance somewhat inside with respect to the side reference line. This gives an extra room for the travelling sheet paper, thereby eliminating the chance of jamming due to slight disorientation.

It is therefore an object of the present invention to provide a sheet paper stacking apparatus which enables to arrange a plurality of sheets of paper supplied one by one in the form of a stack, which is properly oriented and aligned, without failure.

It is another object of the present invention to provide a sheet paper stacking apparatus which has a front reference plate and a side reference plate to which sheets of paper are forcibly brought into contact as placed one on another to form a desired stack of sheets of paper.

It is a further object of the present invention to provide a sheet paper stacking apparatus which is provided with a front reference plate and a side reference plate with a predetermined gap therebetween in order to avoid the occurrence of jamming or bending the corner portion of a sheet of paper.

It is still a further object of the present invention to provide a sheet paper stacking apparatus which may be advantageously applied to a duplex copying or printing machine without elaborate modifications.

It is still a further object of the present invention to provide a sheet paper stacking apparatus which is simple in structure, easy to manufacture and free of malfunctioning.

Other objects, advantages and novel features of the present invention will become apparent from the following detailed description of the invention when considered in conjunction with the accompanying drawings. It is to be noted, however, that although the following detailed description will be had with respect to the case where the present invention is applied to a duplex copying machine, it should be understood that the present invention may also be applied to other situations such as duplex printing.

DESCRIPTION OF THE PREFERRED EMBODIMENTS

Figure 1:
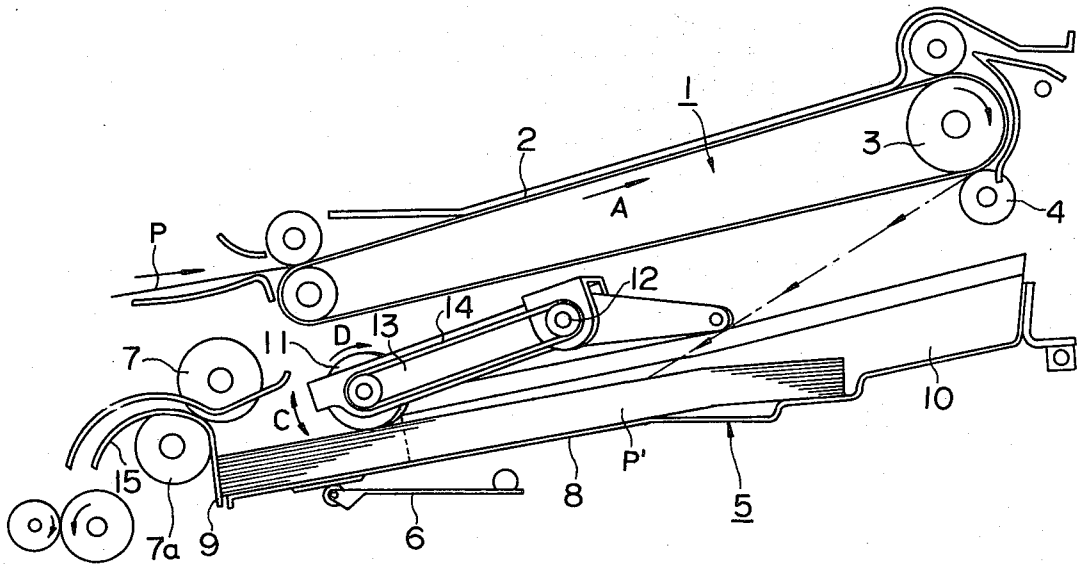
FIG. 1 is a front elevational view of one embodiment of the present sheet paper stacking apparatus showing the state when sheets of paper are supplied one by one to form a stack.
Figure 2:
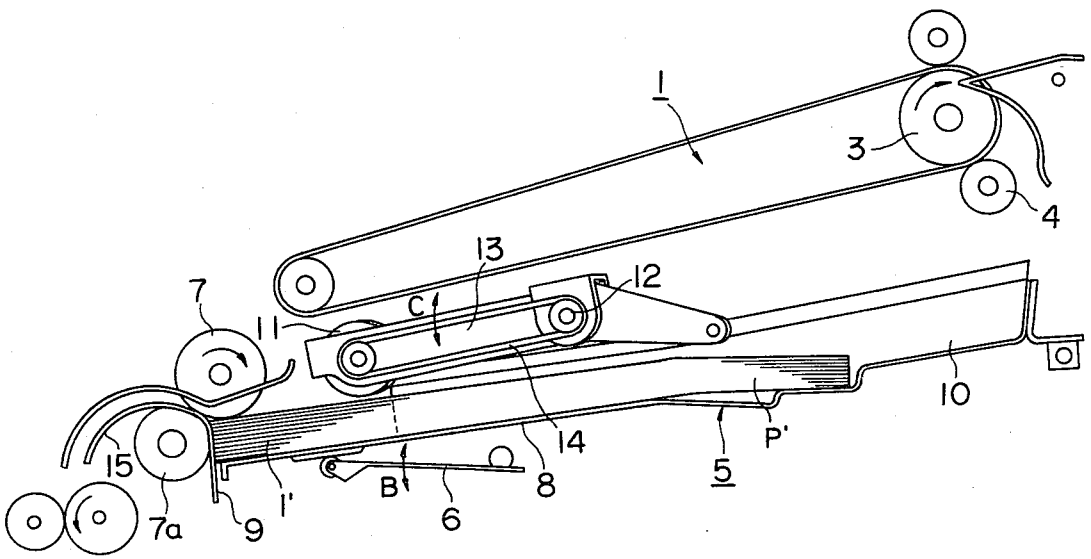
FIG. 2 is the same view as that of FIG. 1 showing the state when stacked sheets of paper are discharged. one by one.

Referring now to the drawings wherein like numerals represent like elements, and in particular to FIGS. 1 and 2, the present sheet paper stacking apparatus is constructed generally in the form of a tray 5, above which is disposed a transporting and turning device 1 for sheets of paper, including a conveyor belt 2, a turn roller 3 and a pick-up roller 4. The conveyor belt 2 is driven to advance in the direction indicated by the arrow A, and, therefore, a sheet paper P may be transported while riding thereon. A toner image formed on a photosensitive drum (not shown) has been transferred and fixed to the top surface of the sheet of paper P before entering into the transporting and turning device 1; whereas, the sheet of paper P bears no reproduced image on the bottom surface.

The sheet of paper P becomes turned upside down as it moves around the turn roller 3. Then, the sheet of paper P is removed from the conveyor belt 2 by means of pick-up roller 4 to be transported into the tray 5. While the sheet paper P is transported along by the conveyor belt 2, one side edge of the sheet of paper P is kept aligned with a predetermied reference line irrespective of its size, e.g., B4, B5 or A3, A4, etc. When the sheet of paper P enters into the tray 5, it rides on a stack P' to become a part of it. Thus, the stack P' is formed by a plurality of sheets of paper P arranged one upon another.

When the number of sheets of paper P stacked in the tray 5 reaches a predetermined value, the tray 5 is moved upward so that the topmost sheet of the stack P' is brought into contact with a delivery roller 7, which is journaled in the frame for intermittent rotation in association with the rotation of the photosensitive drum. The upward motion of the tray 5 may be carried out by means of any conventional technique. For example, a control arm 6 may be pivotally provided with its forward end in contact with a bottom plate 8 of the tray 5. The bottom plate 8 may be made of a flexible material so that the pivotal motion of the control arm 6 as shown by the arrow B in FIG. 2 allows the topmost sheet of the stack P' to be contacted with the roller 7. On the other hand, the tray 5 itself may be pivotally provided to attain a required contact between the delivery roller 7 and the topmost sheet of the stack P'. It is to be noted that the pivotal motion of the control arm 6 is so controlled that the contact pressure between the roller 7 and the topmost sheet of the stack P' is kept at a predetermined value. Thus, the sheets of paper P forming the stack P' may be discharged one by one out of the tray 5 by the action of the delivery roller 7 and a counter roller 7*a* in synchronism with the rotation of the photosensitive drum for processing the reverse side, which now faces upward, of the sheet of paper P.

The present sheet paper stacking apparatus, generally formed in the shape of the tray 5, comprises the bottom plate 8 on which the stack P' of sheets of paper P is formed, a front reference plate 9 against which the front edge of the sheets of paper P abut, a side reference plate against which one side edge of the sheets of paper P abuts, and an inclined roller 11 for bringing the sheets of paper P into contact with the front and side reference plates for proper positioning.

The front reference plate 9 is fixedly mounted on the frame at a position in the neighborhood of the front end of the bottom plate 8. The disposition of the plate 9 is such that it generally forms a right angle with the bottom plate 8. The plate 9 is connected to a guide plate 15 to provide a smooth discharging path. The side reference plate 10 is attached to one side of the bottom plate 8 at a right angle. The plate 10 is also arranged to be perpendicular to the front reference plate 9.

Figure 3:
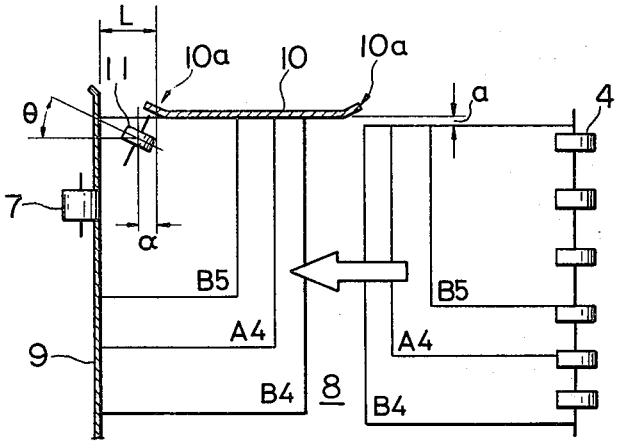
FIG. 3 is a schematic plan view showing the arrangement of front and side reference plates with respect to the advancing direction of differently sized sheets of paper.

The inclined roller 11 is rotatably provided at the free end of a support arm 13 which may pivot around a driving shaft 12 as shown by the arrow C. The inclined roller 11 is continuously driven to rotate in the direction as shown by the arrow D through a belt 14 driven by the driving shaft 12 when the sheets of paper P are being fed. During a sheet paper receiving period as shown in FIG. 1, the inclined roller 11 rests on the topmost sheet of the stack P' by its own weight to impart an appropriate force thereon. Since the inclined roller 11 is arranged with an inclined angle $\theta$ with respect to the line normal to the front reference plate 9 as shown in FIG. 3, rotation of the inclined roller 11 in the direction D will bring the sheets of paper P into contact with the front and side reference plates for alignment. Once the sheets of paper P are properly positioned, the inclined roller 11 slips on top sheet of paper P because the contact force therebetween is previously determined appropriately. For the inclined roller 11 to slip as desired in order to avoid the occurrence of jamming, the weight of the roller 11 and coefficient of friction between the top sheet of paper P and the roller 11 are two important factors. It has been experimentally found that a sponge rubber may be preferably used as a material for the roller 11. It is to be noted, however, that the desired contact pressure between the roller 11 and the top sheet of paper P may be obtained by suitably selecting the weight of the roller 11 or providing a spring or the like.

During a sheet paper discharging period for discharging sheets of paper one by one from the present apparatus for processing the remaining side, the bottom plate 8 is moved upward by means of the control arm 6 to bring the topmost sheet of the stack into contact with the roller 7. At the same time, the support arm 13 is pivoted around the driving shaft 12 clockwisely in association with the pivotal movement of the control arm 6 to locate the roller 11 at a position separated away from the topmost sheet of the stack P'. If desired, it may be so structured that the bottom plate 8 shifts sideways over the distance a in the direction toward the viewer prior to or during the upward motion thereof so as to locate the discharging sheet paper P properly in the travelling path. Such shifting of the bottom plate 8, or the stack P', is necessary if the side reference line of the discharging path does not correspond to the surface of the side reference plate 10.

As shown in FIG. 3, the side reference plate 10 is disposed at an appropriate distance a outside of the side reference line of the incoming sheet paper P. As a result, even if the incoming sheet of paper P is somewhat disoriented or shifted sideways with respect to the centerline of the sheet paper travelling path, it can avoid the occurrence of jamming, or riding on the plate 10. Also as shown in FIG. 3, both ends 10*a*, 10*a* of the side reference plate 10 are bent outwardly to provide round corners, which will help obviate the occurrence of jamming. It is to be noted that a gap L is provided between the front reference plate 9 and the front end of the side reference plate 10. And, the inclined roller 11 is located at a distance $\alpha$ downstream of the front end of the plate 10.

Figure 4:
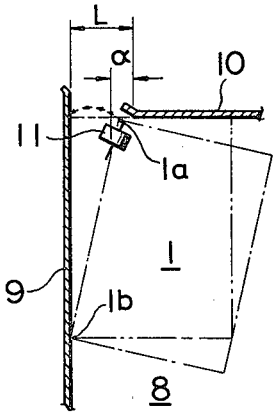
FIG. 4 is another schematic plan view showing the situation when a disoriented sheet of paper comes into contact with the front reference plate.

Referring now to FIG. 4, explanation will be had as regards the function of gap L. If the sheet of paper P is disoriented as shown by the one-dotted line when it comes into contact with the inclined roller 11, the corner 1*b* will first reach the plate 9 and then the sheet of paper P will be rotated around the corner 1*b*. The locus of the corner 1*a* in this event is shown by the arrows in FIG. 4. Thus, if the plate 10 were extended over the distance L, the corner 1*a* would come into contact with the plate 10, and, therefore, the sheet of paper P could be left improperly positioned. Furthermore, if the force applied by the inclined roller 11 to the sheet of paper P were substantially strong, then the corner 1*a* of the sheet of paper P could be bent, or jamming could occur in the worst case.

On the other hand, in accordance with the embodiment of the present invention, since the plate 10 is not present over the distance L, the corner 1*a* can move freely without any interference along its locus. This permits the sheet of paper P to be properly aligned with the front and side reference plates 9 and 10.

As above described, the present invention made it possible to arrange a plurality of sheets of paper supplied one by one in the form of a stack having a desired alignment irrespective of the size of sheets of paper used. It should be appreciated that the present invention made it possible to attain desired effects with a simple structure, and, therefore, it is easy to manufacture and easy to operate. Smaller number of parts also indicates minimum requirements for maintenance and less likehood of malfunctioning.

While the above provides a full and complete disclosure of the preferred embodiment of the invention, various modifications, alternate constructions and equivalents may be employed without departing from the true spirit and scope of the invention. Therefore, the above description and illustrations should not be constructed as limiting the scope of the invention, which is defined by the appended claims.

What is claimed is:

1. Apparatus for receiving sheets of paper one by one to arrange them in the form of a stack and then discharging the thus stacked sheets of paper one by one, comprising:

a bottom plate on which said stack is to be formed;

side reference means for providing a side reference line with which one side edge of each of said sheets of paper is to be aligned;

front reference means for providing a front reference line with which the front edge of each of said sheets of paper is to be aligned;

rotating means disposed above said bottom plate, said rotating means being movable between two positions including an operative position where said rotating means brings said sheets of paper into alignment with said side and front reference lines during a sheet paper receiving mode and an inoperative position where said rotating means is separated away from said stack during a sheet paper discharging mode;

a discharging path for receiving sheets from said stack, said discharging path extending from an entrance thereto located above said front reference means;

discharging means disposed in the vicinity of the entrance of said discharging path for discharging said stacked sheets of paper one by one upon contact during a sheet paper discharging mode; and control means for changing the relative positional relation between said bottom plate and said discharging means such that the topmost sheet of said stack is located away from said discharging means during a sheet paper receiving mode and the topmost sheet of said stack is in contact with said discharging means during a sheet paper discharging mode.

2. The apparatus as defined in claim 1 wherein said discharging means includes a delivery roller which is fixedly provided in space, and said bottom plate is movable with respect to said delivery roller.

3. The apparatus as defined in claim 2 wherein said control means includes a control arm which is connected to said bottom plate for controlling the relative positional relation between said delivery roller and said bottom plate.

4. An apparatus as defined in claim 1 wherein said rotating means includes a support arm and a roller rotatably provided at the forward end of said support arm and continuously driven to rotate in a predetermined direction, the axis of rotation of said roller being inclined with respect to said side and front reference lines such that each of said sheet papers may be brought into alignment with said side and front reference lines when it is transported by said roller, said support arm being set in a freely pivotal state during a sheet paper receiving mode thereby allowing said roller to ride on the topmost sheet of said stack by its own weight and said support armm being set in a fixed state during a sheet paper discharging mode thereby locating said roller in a position away from the topmost sheet of said stack.

5. An apparatus as defined in claim 1 further comprising feeding means disposed at the end opposite to the front end of said bottom plate for feeding sheets of paper one by one onto said bottom plate or onto the topmost sheet of said stack formed on said bottom plate while said apparatus is in a sheet paper receiving mode.

6. An apparatus as defined in claim 5 wherein said feeding means includes a transporting-and-turning means for feeding sheets of paper one by one onto said bottom plate after having turned them upside down.

7. An apparatus as defined in claim 1 wherein said side reference means includes a side reference plate disposed substantially perpendicularly to said bottom plate and said front reference means includes a front reference plate disposed substantially perpendicularly to said bottom plate and said side reference plate, whereby said side and front reference lines are defined by the surfaces of said respective plates.

8. An apparatus as defined in claim 7 wherein said side reference plate is integral with said bottom plate.

9. An apparatus as defined in claim 4 wherein said roller is made of sponge rubber.

10. An apparatus as defined in claim 7 wherein a predetermined gap is provided between said side reference plate and said front reference plate.

11. An apparatus as defined in claim 10 wherein said gap is provided by terminating said side reference plate at a predetermined distance from said front reference plate.

12. An apparatus as defined in claim 11 wherein both ends of said side reference plate include round corners.

13. An apparatus as defined in claim 7 wherein said side reference plate is disposed at a predetermined distance outside of the side reference line for the incoming sheet of paper.

* * * * *